US010144233B2

(12) United States Patent
Onodera

(10) Patent No.: US 10,144,233 B2
(45) Date of Patent: Dec. 4, 2018

(54) GAP ADJUSTMENT METHOD OF AN INK JET DEVICE AND AN INK JET DEVICE

(71) Applicant: MIMAKI ENGINEERING CO., LTD., Nagano (JP)

(72) Inventor: Akihiro Onodera, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/546,665

(22) PCT Filed: Apr. 8, 2016

(86) PCT No.: PCT/JP2016/061526
§ 371 (c)(1),
(2) Date: Jul. 27, 2017

(87) PCT Pub. No.: WO2016/163513
PCT Pub. Date: Oct. 13, 2016

(65) Prior Publication Data

US 2018/0022124 A1 Jan. 25, 2018

(30) Foreign Application Priority Data

Apr. 9, 2015 (JP) ..... 2015-080340

(51) Int. Cl.
*B41J 2/045* (2006.01)
*B41J 2/21* (2006.01)
(Continued)

(52) U.S. Cl.
CPC ..... *B41J 25/308* (2013.01); *B41J 2/01* (2013.01); *B41J 2/04505* (2013.01);
(Continued)

(58) Field of Classification Search
CPC ..... B41J 2/01; B41J 2/04505; B41J 2/2135; B41J 11/20; B41J 25/308; B41J 25/3082;
(Continued)

(56) References Cited

U.S. PATENT DOCUMENTS 5,476,328 A * 12/1995 Hori ..... B41J 25/308 400/56
5,975,666 A * 11/1999 Kawaguchi ..... B41J 25/308 347/8
(Continued)

FOREIGN PATENT DOCUMENTS

JP H05155009 6/1993
JP 2004243552 9/2004
(Continued)

OTHER PUBLICATIONS

"International Search Report (Form PCT/ISA/210) of PCT/JP2016/061526", dated Jul. 5, 2016, with English translation thereof, pp. 1-2.

*Primary Examiner* — Anh T. N. Vo
(74) *Attorney, Agent, or Firm* — JCIPRNET

(57) ABSTRACT

A gap adjustment method of an ink jet device includes a head unit with an ink discharge port that discharges ink, a carriage that is provided with the head unit and moves in a main scanning direction, a print medium provided with a gap with respect to the ink discharge port, and a gap driving unit that adjusts a length of the gap. The gap adjustment method includes a discharging process (step ST4) and a gap adjusting process (step ST5 to step ST56). In the discharging process (step ST4), ink is discharged in each of a forward path and a backward path while reciprocating the carriage in the main scanning direction. In the gap adjusting process, a forward path landing position and a backward path landing position, and an optimum landing position determined in
(Continued)

advance are compared, and the length of the gap is adjusted with the gap driving unit.

8 Claims, 8 Drawing Sheets

(51) Int. Cl.

| | |
|---|---|
| ***B41J 11/20*** | (2006.01) |
| ***B41J 25/308*** | (2006.01) |
| ***B41J 2/01*** | (2006.01) |
| ***B41J 29/46*** | (2006.01) |
| ***B41J 3/407*** | (2006.01) |
| ***B41J 11/00*** | (2006.01) |
| ***B41J 29/38*** | (2006.01) |

(52) U.S. Cl.
CPC ..... *B41J 2/2135* (2013.01); *B41J 3/4073* (2013.01); *B41J 11/008* (2013.01); *B41J 11/20* (2013.01); *B41J 29/38* (2013.01); *B41J 29/46* (2013.01)

(58) Field of Classification Search
CPC .. B41J 25/3086; B41J 25/3088; B41J 25/312; B41J 25/316; B41J 25/32; B41J 25/34; B41J 2029/3935
See application file for complete search history.

(56) References Cited

U.S. PATENT DOCUMENTS 6,666,537 B1 * 12/2003 Kelley ..... B41J 25/308 347/19
7,942,493 B2 * 5/2011 Watanabe ..... B41J 29/393 347/14
9,211,743 B2 * 12/2015 Izuo ..... B41J 25/3086

FOREIGN PATENT DOCUMENTS

JP 2004314361 11/2004
JP 2008155399 7/2008

* cited by examiner

GAP ADJUSTMENT METHOD OF AN INK JET DEVICE AND AN INK JET DEVICE

CROSS-REFERENCE TO RELATED APPLICATION

This application is a 371 application of the international PCT application serial no. PCT/JP2016/061526, filed on Apr. 8, 2016, which claims the priority benefits of Japan Patent Application No. 2015-080340, filed on Apr. 9, 2015. The entirety of each of the above-mentioned patent applications is hereby incorporated by reference herein and made a part of this specification.

TECHNICAL FIELD

The present invention relates to a gap adjustment method of an ink jet device for adjusting a length of a gap of an ink discharge port and a landing target object, and an ink jet device.

BACKGROUND ART

In an ink jet device such as an ink jet printer that naturally drops an ink droplet while moving a carriage in a main scanning direction, a gap of an ink discharge port and a landing target object needs to be adjusted to an appropriate distance to land the ink droplet at an appropriate position. However, if an adjustment of an accuracy of smaller than or equal to 0.1 mm is required when adjusting the length of the gap, the visual adjustment using a scale, and the like becomes very difficult. Thus, an adjustment method in which the accuracy of smaller than or equal to 0.1 mm is required is proposed in Patent Literature 1 and Patent Literature 2.

Patent Literature 1 discloses a method of measuring a gap with a photosensor, and adjusting the length of the gap according to the measurement result. Patent Literature 2 discloses an examination method of an ink jet head of creating a calibration curve indicating a shift in a landing position and an interval with a gap, and detecting a position shift distance of an ink discharge port according to the calibration curve.

CITATION LIST

Patent Literatures

Patent Literature 1: Japanese Unexamined Patent Publication No. 5-155009

Patent Literature 2: Japanese Unexamined Patent Publication No. 2008-155399

SUMMARY OF INVENTION

Technical Problems

However, if the gap is measured with the method described in Patent Literature 1, an expensive and complex mechanism such as a photosensor becomes necessary, and reliability also becomes difficult to ensure. Furthermore, in the method described in Patent Literature 2, a need to recreate a calibration curve according to change in environment, and the like arises, and convenience is poor.

In light of the foregoing, the present invention provides a gap adjustment method of an ink jet device, and an ink jet device that can enhance the convenience even if the ink jet device has a simple configuration.

Solutions to the Problems

In order to solve the problem described above, a gap adjustment method of an ink jet device according to the present invention relates to a gap adjustment method of an ink jet device including a head unit with an ink discharge port that discharges ink, a carriage that is provided with the head unit and that moves in a main scanning direction, a landing target object provided with a gap with respect to the ink discharge port, and a gap adjustment means that adjusts a length of the gap; the gap adjustment method including a discharging process of discharging ink from the ink discharge port while reciprocating the carriage in the main scanning direction, and landing an ink droplet to each of a forward path landing position, which is a position on the landing target object the ink droplet is to be landed in a forward path of the carriage, and a backward path landing position, which is a position on the landing target object the ink droplet is to be landed in a backward path of the carriage; and a gap adjusting process of comparing actual measurement values based on the forward path landing position and the backward path landing position the ink droplet actually landed in the discharging process, and optimum values based on respective optimum landing positions of the forward path landing position and the backward path landing position determined in advance according to a desired gap, and adjusting the length of the gap with the gap adjustment means based on a shift of the actual measurement values and the optimum values.

According to the present invention, in the discharging process, the ink is discharged in each of the forward path and the backward path, and in the gap adjusting process, the length of the gap is adjusted by the gap adjustment means on the basis of an optimum value based on an optimum landing position determined in advance, and an actual measurement value based on the landing position formed in the discharging process. Thus, the length of the gap can be adjusted without using an expensive sensor such as a photosensor. Furthermore, since the length of the gap is adjusted by the gap adjustment means on the basis of the optimum value based on the optimum landing position determined in advance, and the actual measurement value based on the landing position formed by the discharging process, the calibration curve does not need to be recreated according to the change in environment, and the convenience can be enhanced. Thus, in the gap adjustment method of the ink jet device according to the present invention, the convenience can be enhanced even if the ink jet device has a simple configuration.

In the gap adjustment method of the ink jet device, the adjustment of the length of the gap is preferably carried out based on a separated distance of the actual measurement values of the forward path landing position and the backward path landing position and/or a position relationship of each other in the main scanning direction.

In the present invention, the degree of adjusting the length of the gap is determined with the actual measurement value based on the forward path landing position and the backward path landing position, and thus the degree of adjusting the length of the gap can be determined by landing the ink while moving the carriage at least one time each in the forward path and the backward path. Therefore, the present invention can rapidly adjust the length of the gap even if the ink jet device has a simple configuration.

Furthermore, according to the gap adjustment method of the ink jet device, in the discharging process, the ink droplet is preferably landed at three or more areas in each of the forward path and the backward path, and an interval of discharging the ink in the forward path and an interval of discharging the ink in the backward path are preferably differed.

In the present invention, the actual measurement values based on the forward path landing position and the backward path landing position of three or more areas are formed, so that the shift between the actual measurement values based on the forward path landing position and the backward path landing position can be definitely determined. Furthermore, since the shift is grasped on the basis of the actual measurement values based on the forward path landing position and the backward path landing position of three or more areas, the direction of shift, the position of small shift, and the like can be grasped.

According to the gap adjustment method of the ink jet device, in the discharging process, a moving speed of the carriage when discharging the ink from the ink discharge port is preferably constant.

In the present invention, the moving speed of the carriage is constant, and hence the gap to become an optimum value based on the optimum landing position can be easily grasped. Furthermore, the shift range of the actual measurement values based on the forward path landing position and the backward path landing position becomes constant, and discrimination can be easily carried out.

According to the gap adjustment method of the ink jet device, in the discharging process, information contributing to determining a degree of adjusting the length of the gap in the gap adjusting process is preferably provided on the landing target object.

In the present invention, the degree of adjusting the length of the gap in the gap adjusting process can be rapidly determined even if the ink jet device has a simple configuration by the information contributing to determination, and the convenience can be enhanced.

According to the gap adjustment method of the ink jet device, in the discharging process, the ink is preferably landed on a thin film attached to the landing target object in a strippable manner.

In the present invention, the discharging process is carried out on the thin film attached to the landing target object in a strippable manner, and hence the landing target object can be assumed as a print medium to which the ink jet device carries out printing. Thus, in the present invention, the length of the gap can be adjusted by actually landing the ink with respect to the print medium, whereby the length of the gap can be reliably adjusted without being influenced by the variation in the dimension of the print medium. Furthermore, the length of the gap can be adjusted without getting the print medium dirty since the strippable thin film is used.

According to the gap adjustment method of the ink jet device, in the discharging process, an interval of discharging the ink to land the ink droplet at three or more areas in the forward path is preferably constant, and an interval of discharging the ink to land the ink droplet at three or more areas in the backward path is preferably constant.

In the present invention, the interval of discharging the ink in each of the forward path and the backward path is constant, and thus the degree of adjusting the length of the gap can be rapidly determined even if the ink jet device has a simple configuration on the basis of the actual measurement value based on the landing position formed by discharging the ink.

In order to solve the problem described above, an ink jet device according to the present invention relates to an ink jet device including a head unit with an ink discharge port that discharges ink, a carriage that is provided with the head unit and that moves in a main scanning direction, a landing target object provided with a gap with respect to the ink discharge port, and a gap adjustment means that adjusts a length of the gap; in which ink is discharged from the ink discharge port while reciprocating the carriage in the main scanning direction, and an ink droplet is landed to each of a forward path landing position, which is a position on the landing target object the ink droplet is to be landed in a forward path of the carriage, and a backward path landing position, which is a position on the landing target object the ink droplet is to be landed in a backward path of the carriage to form a check pattern on the landing target object; and a length of the gap is adjusted with the gap adjustment means based on the check pattern.

In the present invention, the length of the gap is adjusted by the gap adjustment means on the basis of the actual measurement value based on the landing position formed by discharging ink in each of the forward path and the backward path. Thus, the length of the gap can be adjusted without using an expensive sensor such as a photosensor. Furthermore, since the length of the gap is adjusted by the gap adjustment means based on the check pattern, the calibration curve does not need to be recreated according to the change in environment, and the convenience can be enhanced. Thus, the ink jet device has a simple configuration and can enhance the convenience.

Moreover, the ink jet device described above further preferably includes a position determining means that defines the forward path landing position and the backward path landing position of the landing target object in the main scanning direction and a sub-scanning direction orthogonal to the main scanning direction when forming the check pattern; and a head position adjustment means that positions the ink discharge port at an appropriate position with respect to the forward path landing position and the backward path landing position.

In the present invention, when forming the check pattern, the forward path landing position and the backward path landing position of the ink on the landing target object can be defined, and the ink discharge port can be positioned at an appropriate position with respect to the forward path landing position and the backward path landing position. Thus, the ink jet device can reliably form the check pattern at a predetermined position of the landing target object.

Effect of the Invention

According to the present invention, the gap adjustment of the ink jet device can be carried out with a simple configuration while enhancing the convenience.

DESCRIPTION OF EMBODIMENT

Hereinafter, an embodiment of a gap adjustment method of an ink jet device, and an ink jet device according to the present invention will be described in detail based on the drawings. It should be recognized that the present invention is not limited by such embodiment. Furthermore, components in the embodiment described below include those that can be replaced by those skilled in the art and are replaced easily, or substantially the same components.

EMBODIMENT

Figure 1:
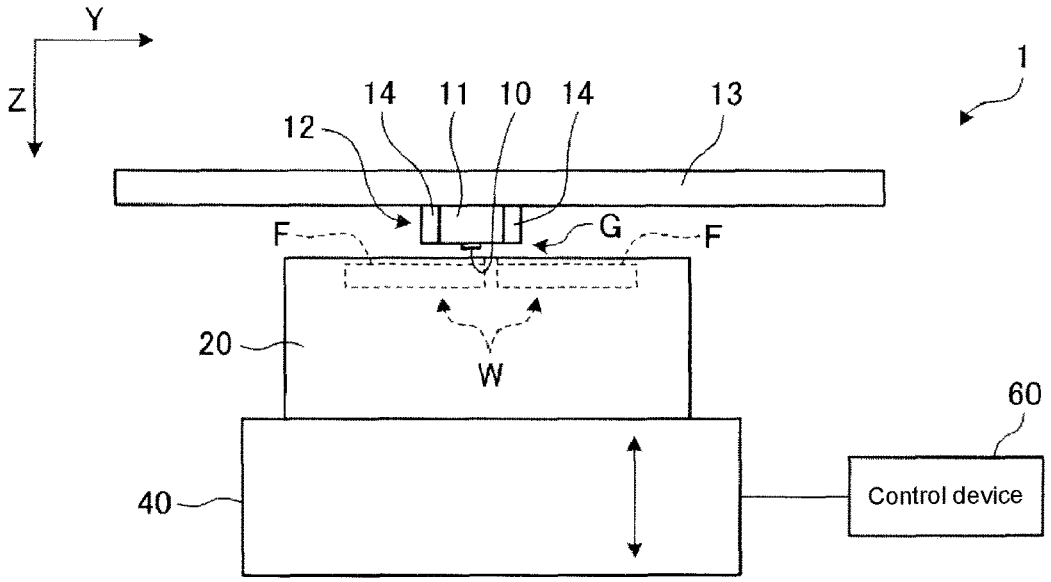
FIG. 1 is a view showing a schematic configuration of an ink jet printer in which a length of a gap is adjusted with a gap adjustment method of an ink jet device according to an embodiment.
Figure 2:
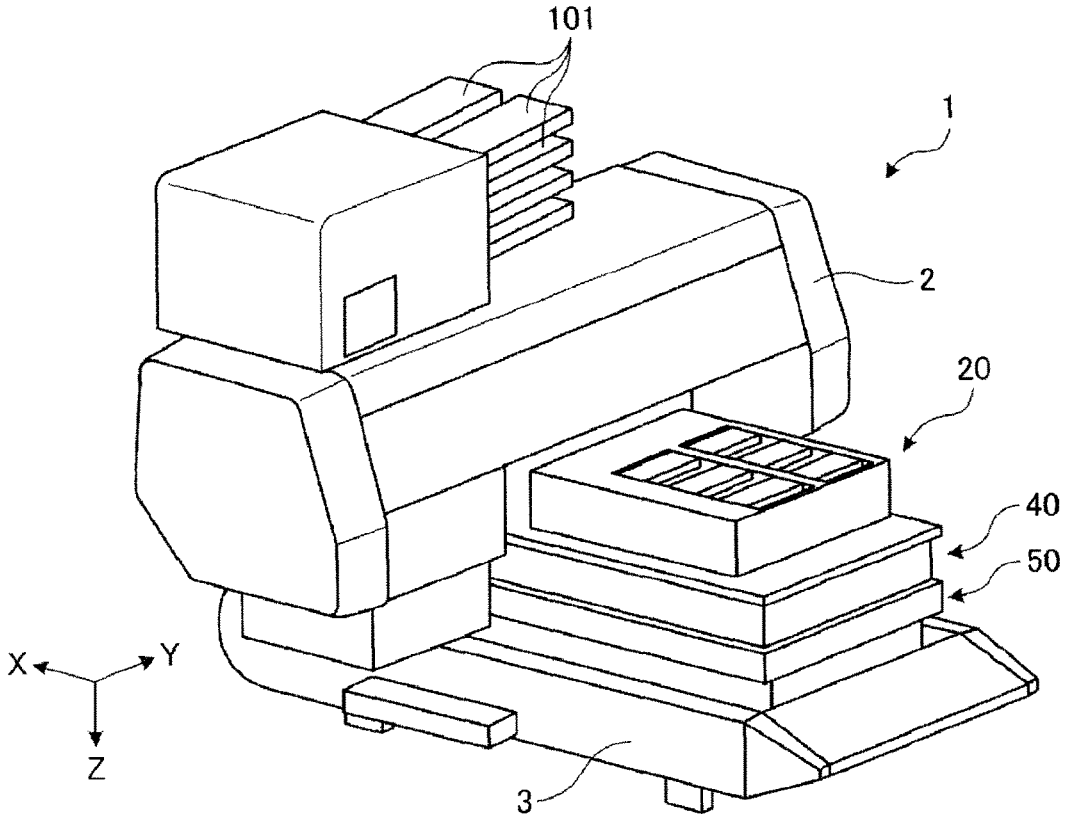
FIG. 2 is a perspective view showing a schematic configuration of the ink jet printer in which the length of the gap is adjusted with the gap adjustment method of the ink jet device according to the embodiment.
Figure 3:
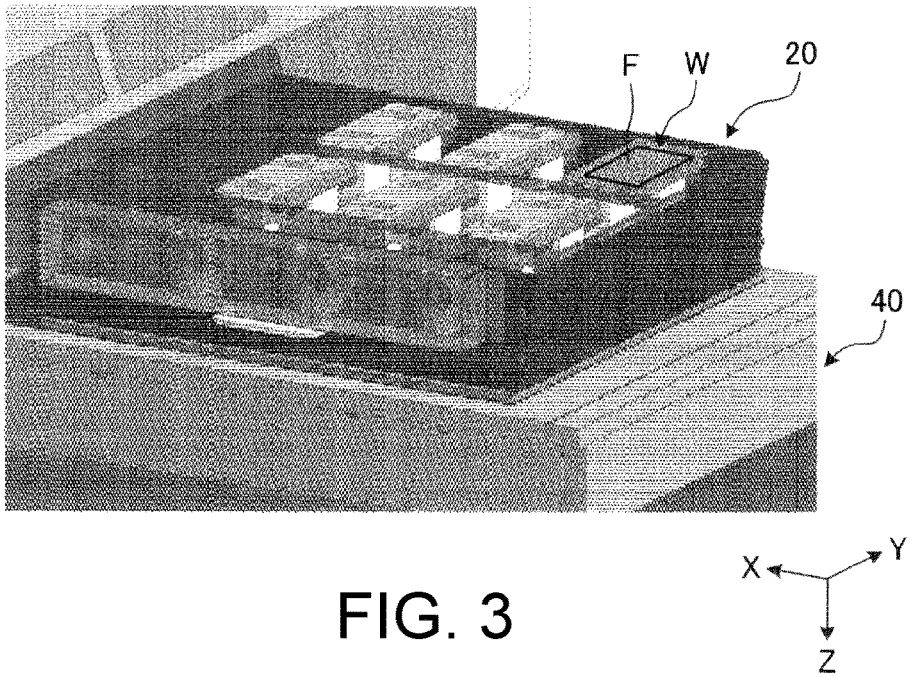
FIG. 3 is a perspective view showing a print medium holding unit and a gap driving unit of the ink jet printer shown in FIG. 2.
Figure 4:
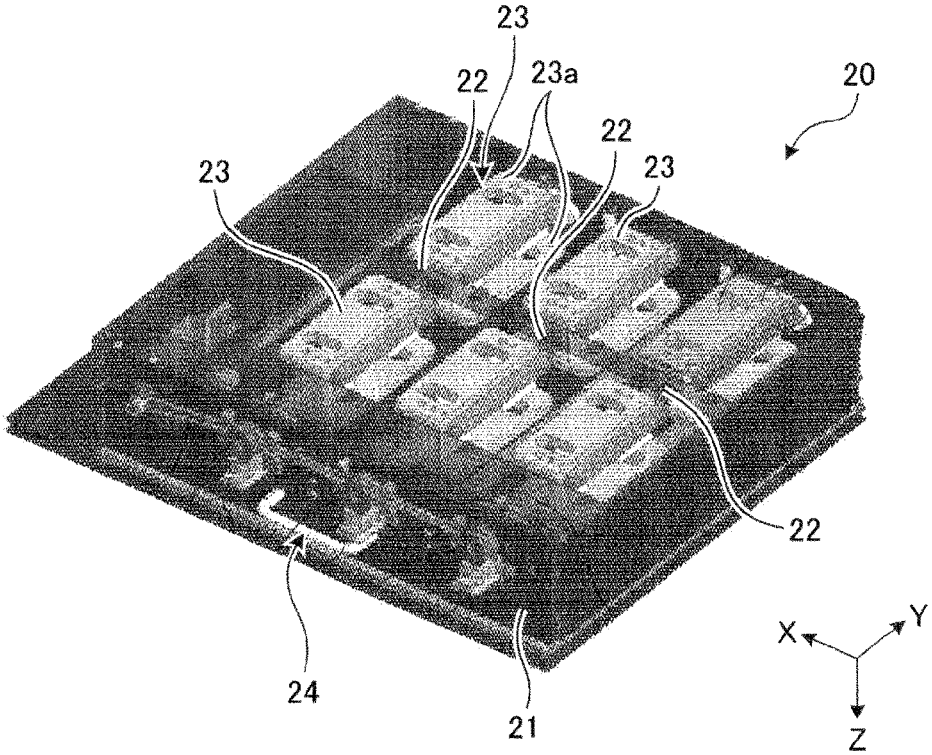
FIG. 4 is a perspective view showing the print medium holding unit of the ink jet printer shown in FIG. 2.
Figure 5:
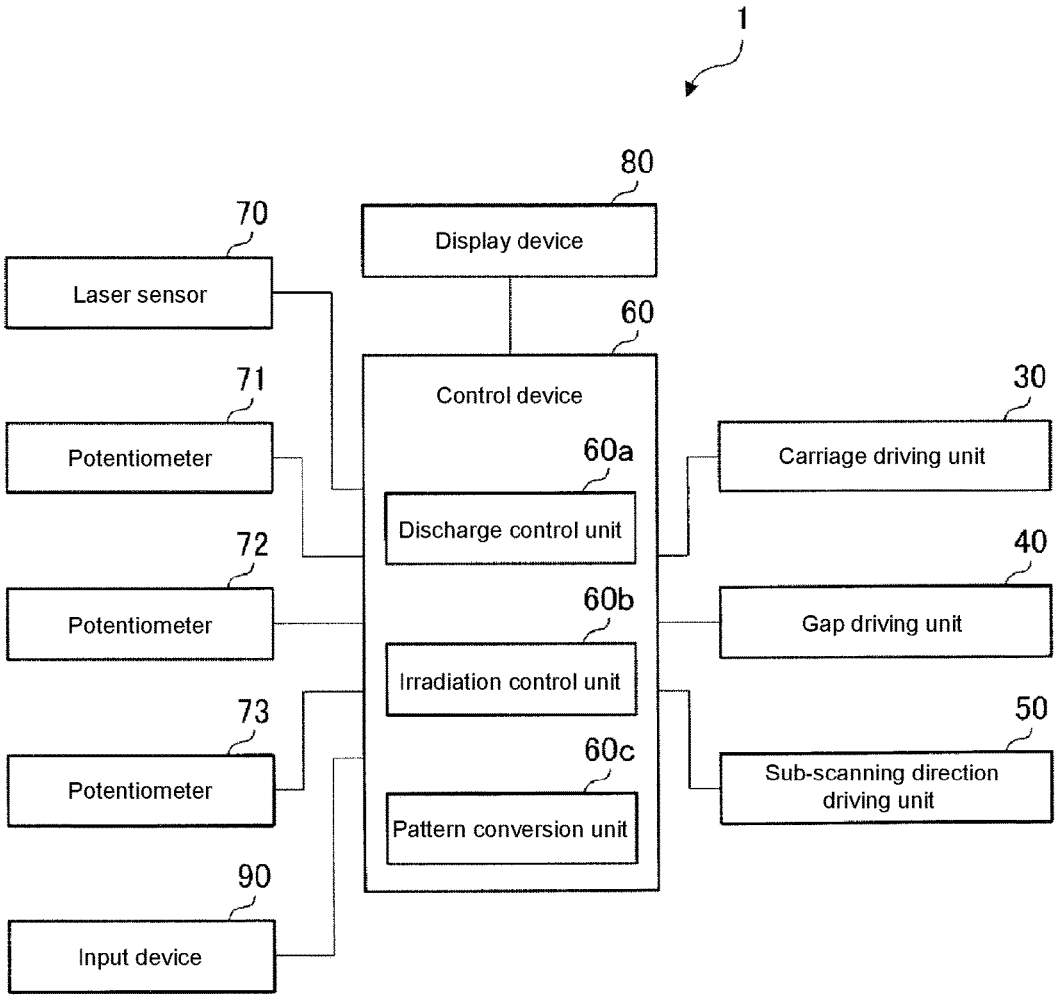
FIG. 5 is a block diagram showing a schematic configuration of the ink jet printer shown in FIG. 2.

FIG. 1 is a view showing a schematic configuration of an ink jet printer in which a length of a gap is adjusted with a gap adjustment method of an ink jet device according to an embodiment. FIG. 2 is a perspective view showing a schematic configuration of the ink jet printer in which the length of the gap is adjusted with a gap adjustment method of the ink jet device according to the embodiment. FIG. 3 is a perspective view showing a print medium holding unit and a gap driving unit of the ink jet printer shown in FIG. 2. FIG. 4 is a perspective view showing the print medium holding unit of the ink jet printer shown in FIG. 2. FIG. 5 is a block diagram showing a schematic configuration of the ink jet printer shown in FIG. 2.

An ink jet printer 1 shown in FIGS. 1 to 3 serving as an example of the ink jet device reciprocates a head unit 11, including a plurality of ink discharge ports 10 that discharge ink supplied from an ink container 101 shown in FIG. 2, in a main scanning direction parallel to a Y-axis direction, and discharges the ink from the ink discharge port 10 onto a print medium W, which is a landing target object, shown in FIG. 3 to print the print medium W. The ink jet printer 1 is a device that carries out printing through the ink jet method on the print medium W. The print medium W is a three-dimensional object, and is, for example, a cover of a mobile terminal such as a smartphone in the present embodiment. The print medium W, which is the cover of the mobile terminal, is a three-dimensional object having a plurality of to-be-printed surfaces such as a first to-be-printed surface and a second to-be-printed surface which is a side surface facing the first to-be-printed surface.

As shown in FIGS. 1 to 3 and FIG. 5, the ink jet printer 1 includes the head unit 11, a carriage 12, a print medium holding unit 20 that holds a plurality of print media W, a carriage driving unit 30, a gap driving unit 40 corresponding to a gap adjustment means, a sub-scanning direction driving unit 50, and a control device 60.

The head unit 11 includes a plurality of ink discharge ports 10 that discharge ink. The head unit 11 is provided so that the plurality of ink discharge ports 10 can discharge ink of one of the colors of M (magenta), C (cyan), Y (yellow), and K (black) accumulated in the ink container 101. The head unit 11 discharges the ink of the color corresponding to the content to print from the ink discharge port 10. The combination of colors to discharge from the head unit 11 may be other than the above. The ink discharge port 10 of the head unit 11 is configured to include, for example, a printer head that discharges the ink while facing the print medium W, various types of ink flow paths that connect the ink container 101 and the printer head, a regulator and a pump provided on the ink flow path, and the like. In the present embodiment, the head unit 11 discharges ink which cure degree changes when irradiated with and exposed to an ultraviolet ray.

The carriage 12 is provided with the head unit 11, and is reciprocated in the main scanning direction along a linear Y bar 13. The carriage 12 prints the to-be-printed surface of the print medium W while moving the head unit 11, which discharges the ink, and an ultraviolet ray irradiator 14, which emits the ultraviolet ray, in the main scanning direction. The carriage 12 is movement controlled in the main scanning direction along the Y bar 13. The carriage 12 includes the head unit 11, and a pair of ultraviolet ray irradiators 14 serving as an exposing unit disposed on both sides in the main scanning direction of the head unit 11. Each ultraviolet ray irradiator 14 can irradiate the ink discharged on the print medium W. Each ultraviolet ray irradiator 14 is configured by, for example, an LED module capable of emitting the ultraviolet ray, and the like.

The print medium holding unit 20 shown in FIG. 3 holds a plurality of print media W with the to-be-printed surface facing the head unit 11. As shown in FIG. 4, the print medium holding unit 20 includes a housing unit 21, a plurality of shaft members 22, a plurality of work set members 23, a rotation driving unit 24, and the like.

The housing unit 21 is a housing portion of the print medium holding unit 20. In the present embodiment, the housing unit 21 is a box-shaped body in which a side that faces the head unit 11 at the time of printing is opened, and rotatably holds each shaft member 22 by supporting one end and the other end of each shaft member 22 with two side surfaces facing each other in the main scanning direction. The housing unit 21 thus functions as a shaft holding unit.

The plurality of shaft members 22 are drive shafts for rotating the print medium W to face the to-be-printed surface of the print medium W toward the head unit 11. In the present example, each shaft member 22 is disposed parallel to the main scanning direction, and is supported in a freely rotating manner about a shaft center by the housing unit 21.

The plurality of work set members 23 are each provided to install the print medium W at a predetermined printable position. With one of the shaft members 22 passed therethrough, the work set member 23 is fixed with respect to the shaft member 22, thus fixing the print medium W with respect to the shaft member 22. The work set member 23 thereby rotates the print medium W with the shaft member 22 according to the rotation of the shaft member 22.

The work set member 23 includes a holding unit 23*a* that holds the print medium W at positions on opposite side to each other with the shaft member 22 as the center. In other words, the work set member 23 includes a pair of holding units 23*a*. Furthermore, two work set members 23 are disposed in a longitudinal direction of each shaft member 22. In other words, each shaft member 22 passes through two work set members 23. Thus, according to the present embodiment, a great number of print media W can be simultaneously held with the print medium holding unit 20.

The rotation driving unit 24 is a driving unit that rotates the plurality of shaft members 22. In the present embodiment, the rotation driving unit 24 includes a plurality of pulleys, a stepping motor, and a timing belt, and rotates each shaft member 22 about the shaft center. The rotation driving unit 24 is electrically connected to the control device 60, so that the drive thereof is controlled by the control device 60.

The print medium holding unit 20 having the configuration described above holds the plurality of media W with a gap G, shown in FIG. 1, with respect to the ink discharge port 10. In other words, the ink jet printer 1 includes the plurality of print media W arranged with the gap G with respect to the ink discharge port 10.

The carriage driving unit 30 is a driving device that relatively reciprocates the carriage 12, that is, the head unit 11 and the ultraviolet ray irradiator 14 in the main scanning direction with respect to the Y bar 13. The carriage driving unit 30 is configured to include, for example, a transmission mechanism such as a transportation belt coupled to the carriage 12, and a drive source such as a motor for driving the transportation belt, and converts a power generated by the drive source to a power for reciprocating the carriage 12 in the main scanning direction through the transmission mechanism, and reciprocates the carriage 12 along the main scanning direction. The carriage driving unit 30 is electrically connected to the control device 60, so that the drive thereof is controlled by the control device 60. In the present embodiment, the carriage 12, the Y bar 13, and the carriage driving unit 30 are accommodated in the housing 2 shown in FIG. 2.

The gap driving unit 40 moves the print medium holding unit 20, that is, the print medium W along the discharging direction of the ink of the head unit 11 with respect to the housing 2, that is, the head unit 11. The discharging direction of the ink of the present embodiment is also referred to as a vertical direction, and is a direction parallel to a Z axis direction. The discharging direction of the ink is a direction the head unit 11 discharges the ink. The gap driving unit 40 thereby adjusts the length of the gap G between the ink discharge port 10 of the head unit 11 and the to-be-printed surface of the print medium W. The gap driving unit 40 moves the print medium holding unit 20 in, for example, a range of about 5 cm in the Z axis direction. Furthermore, in the present invention, the length of the gap G may be adjusted by, for example, moving the head unit 11 along the discharging direction of the ink. In this case, the gap driving unit 40 relatively moves the print medium holding unit 20 with respect to the head unit 11 by, for example, moving the Y bar 13. Furthermore, in the present embodiment, the gap driving unit 40 is installed on a base 3 that supports the housing 2, and is disposed between the base 3 and the print medium holding unit 20.

The sub-scanning direction driving unit 50 is provided to move the print medium holding unit 20, that is, the print medium W in a sub-scanning direction parallel to the X axis direction orthogonal to the main scanning direction with respect to the housing 2, that is, the head unit 11. In the present invention, the head unit 11 may be moved in the sub-scanning direction. In the present embodiment, the sub-scanning direction driving unit 50 is installed on the base 3, and is disposed between the base 3 and the print medium holding unit 20.

When forming check patterns CP1, CP2 shown in FIGS. 8 and 9, to be described later, the carriage driving unit 30, the gap driving unit 40, and the sub-scanning direction driving unit 50 correspond to a head position adjustment means that position the ink discharge port 10 at an appropriate position with respect to a forward path landing position and a backward path landing position of the ink, to be described later.

As shown in FIG. 5, the ink jet printer 1 includes a laser sensor 70, potentiometers 71, 72, 73, a display device 80 that displays various types of information, and an input device 90. The laser sensor 70 is, for example, accommodated in the housing 2 and attached to the head unit 11, and the like to detect the gap G with the print medium W and output the detection result to the control device 60. The potentiometer 71 detects a position in the main scanning direction of the carriage 12 with respect to the Y bar 13, and outputs the detection result to the control device 60. The potentiometer 72 detects a position in the Z axis direction of the print medium holding unit 20 with respect to the base 3, that is, information corresponding to the gap G, and outputs the detection result to the control device 60. The potentiometer 73 detects a position in the sub-scanning direction of the print medium holding unit 20 with respect to the base 3, and outputs the detection result to the control device 60.

The control device 60 controls each unit of the ink jet printer 1 including the head unit 11, each ultraviolet irradiator 14, and the like. The control device 60 is, on a function conceptual basis, configured to include a discharge control unit 60*a*, an irradiation control unit 60*b*, a pattern conversion unit 60*c*, and the like. The control device 60 is also configured from hardware such as an arithmetic device, a memory and the like, and a program for realizing such predetermined functions.

The discharge control unit 60*a* of the control device 60 controls a pump, and the like of each ink discharge port 10 of the head unit 11, and controls a discharging amount, a discharge timing, a discharging period, and the like of the ink to be discharged from the ink discharge port 10. The irradiation control unit 60*b* controls each ultraviolet ray irradiator 14, and the like, and controls an intensity, an irradiation timing, an irradiation period, and the like of the ultraviolet ray to emit from each ultraviolet ray irradiator 14. The pattern conversion unit 60*c* sets the discharge control amount and the irradiation control amount according to the input information input from the input device 90 such as a PC, various terminals, and the like wired/wirelessly connected to the control device 60.

Image information input through the input device 90, and the like, the image information being a predetermined figure, and the like to print on the to-be-printed surface of the print medium W, for example, is input as the input information to the pattern conversion unit 60*c*. The pattern conversion unit 60*c* generates a print pattern to become a predetermined figure to print on the to-be-printed surface of the print medium W based on such input information, and converts the generated print pattern to the achievable discharge control amount and the irradiation control amount. The discharge control unit 60*a* controls the discharge by the ink discharge port 10 of the head unit 11 based on the discharge control amount calculated by the pattern conversion unit 60*c*, and the irradiation control unit 60*b* controls the irradiation by each ultraviolet ray irradiator 14 based on the irradiation control amount calculated by the pattern conversion unit 60*c*.

Figure 8:
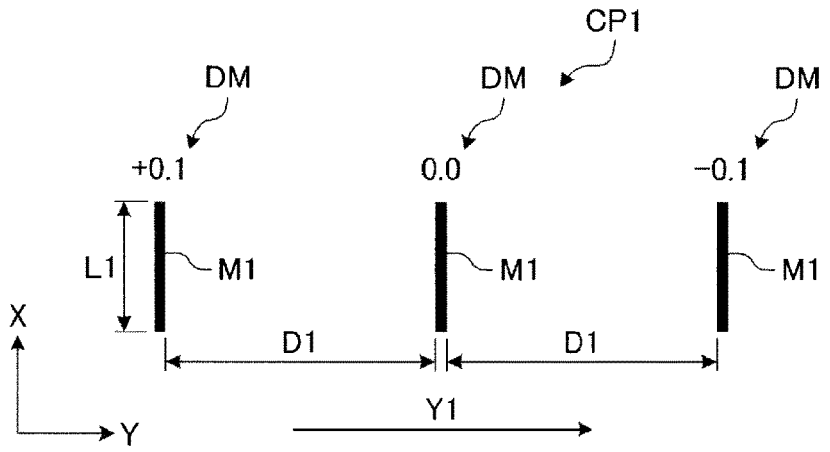
FIG. 8 is a view showing a check pattern in a forward path of the gap adjustment method of the ink jet device according to the embodiment.
Figure 9:
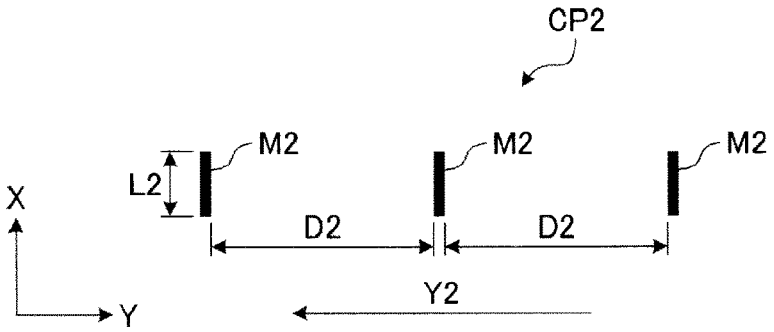
FIG. 9 is a view showing a check pattern in a backward path of the gap adjustment method of the ink jet device according to the embodiment.

Furthermore, the control device 60 stores the check patterns CP1, CP2, shown in FIGS. 8 and 9, to print on the to-be-printed surface of the print medium W at the time of the adjustment of the length of the gap G. The check patterns CP1, CP2 are printed on the to-be-printed surface of the print medium W when adjusting the length of the gap G. The control device 60 is specified with the position to print the check patterns CP1, CP2 in the print medium W from the input device 90. Thus, the input device 90 serves as a position determining means that defines the forward path landing position and the backward path landing position of the ink on the print medium W in the main scanning direction and the sub-scanning direction when forming the check patterns CP1, CP2.

The ink jet printer 1 configured in such manner adjusts the length of the gap G to an appropriate value within a range of, for example, 1.0 mm to 1.5 mm, and then discharges the ink droplet from the head unit 11 with respect to the to-be-printed surface of the print medium W while reciprocating the carriage 12 in the main scanning direction with respect to the print medium W in accordance with the control by the control device 60. The ink jet printer 1 causes each ultraviolet ray irradiator 14 to emit and irradiate the ultraviolet ray to cure the ink landed on the print medium W at a predetermined timing in accordance with the control by the control device 60. The ink jet printer 1 then moves the print medium W in the sub-scanning direction, and thereafter, discharges the ink droplet from the head unit 11 to the to-be-printed surface of the print medium W while reciprocating the carriage 12 in the main scanning direction. The ink jet printer 1 repeats such operations to print a predetermined figure on the to-be-printed surface of the print medium W.

Meanwhile, the control device 60 has the discharge control unit 60*a* control the discharging amount, the discharge timing, the discharging period, and the like of the ink to be discharged from each ink discharge port 10 of the head unit 11, and the irradiation control unit 60*b* control the intensity, and the like of the ultraviolet ray to emit from each ultraviolet ray irradiator 14. The ink jet printer 1 thus can print a predetermined figure on the to-be-printed surface of the print medium W according to the print pattern generated by the pattern conversion unit 60*c*.

Figure 6:
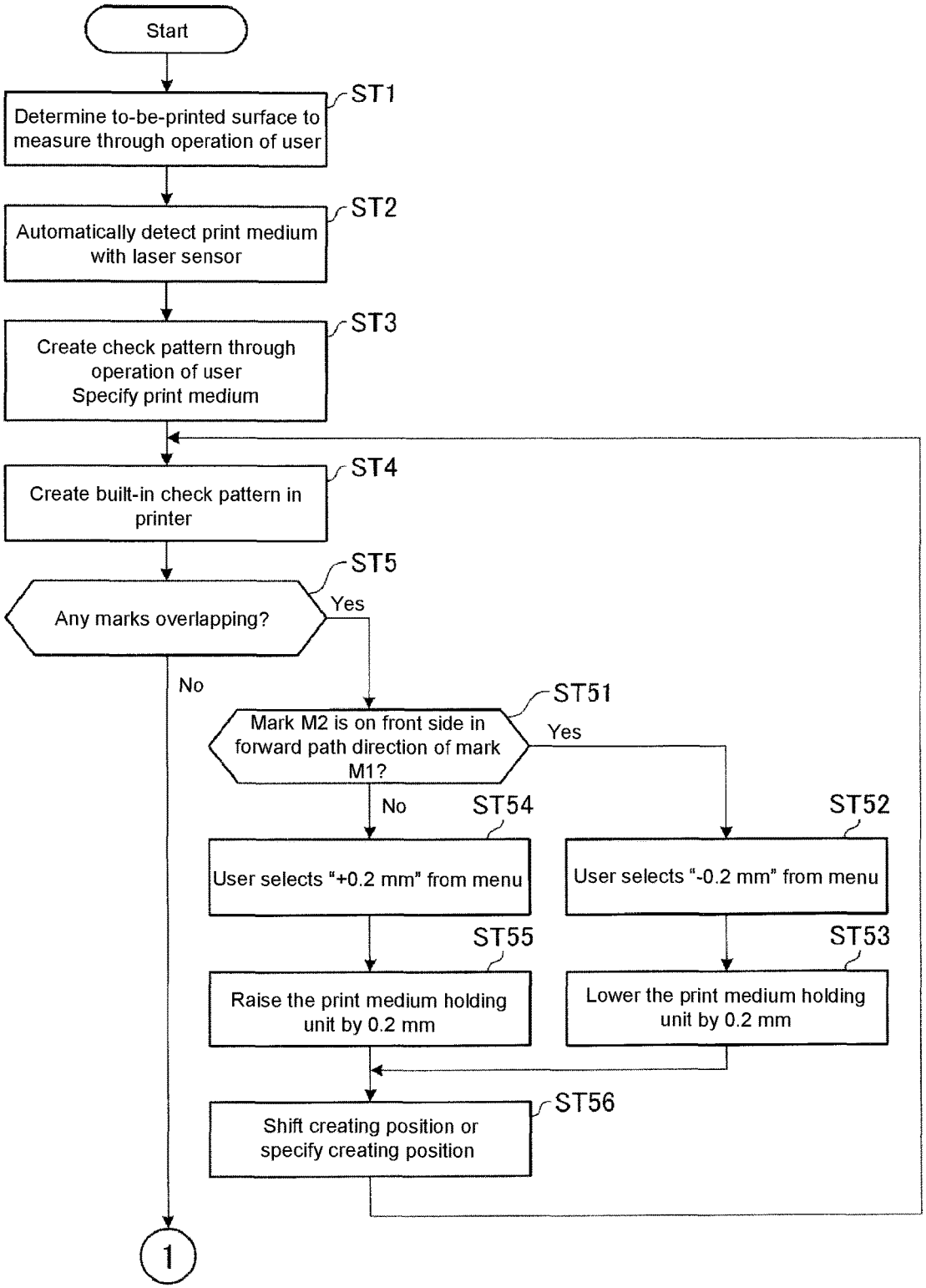
FIG. 6 is a view showing one part of a flow showing one example of the gap adjustment method of the ink jet device according to the embodiment.
Figure 7:
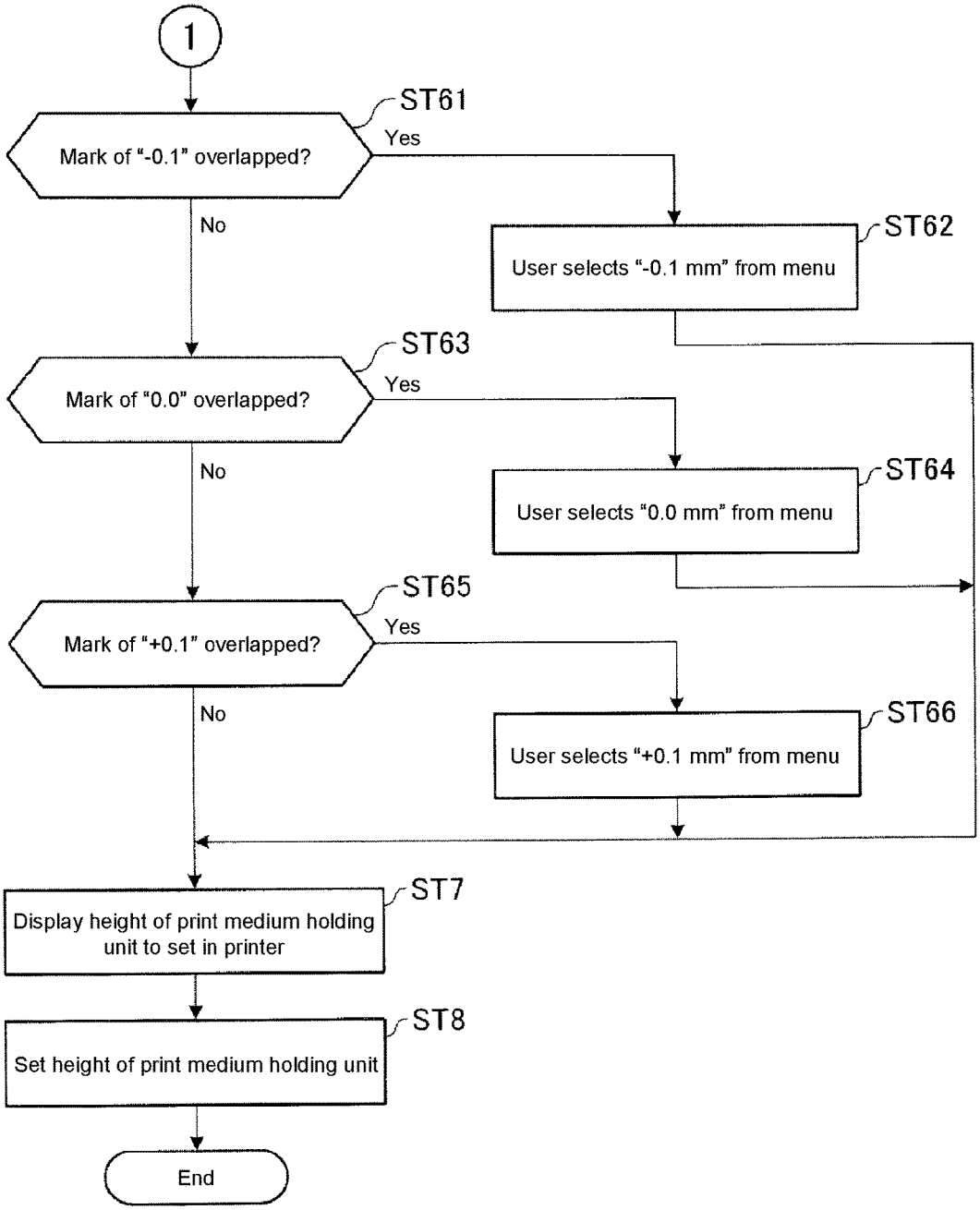
FIG. 7 is a view showing the remaining part of the flow showing one example of the gap adjustment method of the ink jet device according to the embodiment.
Figure 10:
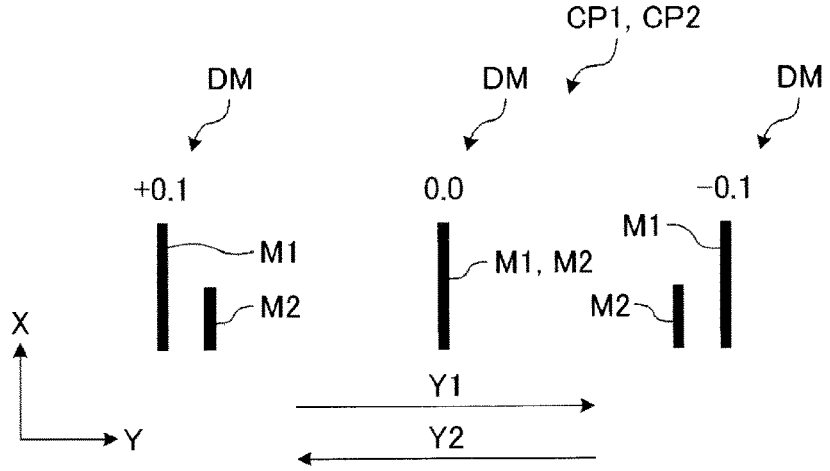
FIG. 10 is a view showing check patterns in the forward path and the backward path of when the gap of the gap adjustment method of the ink jet device according to the embodiment is an appropriate value.
Figure 11:
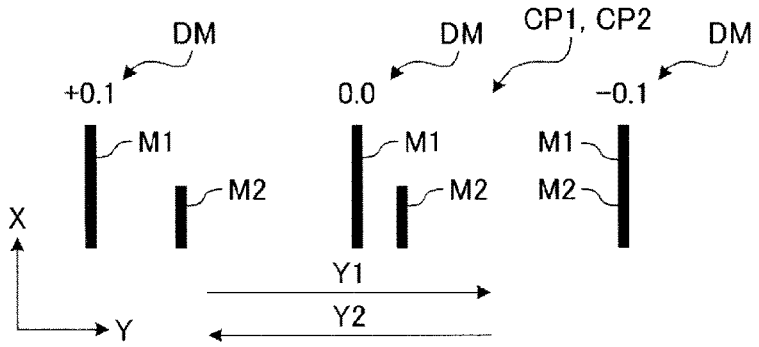
FIG. 11 is a view showing check patterns in the forward path and the backward path of when the gap of the gap adjustment method of the ink jet device according to the embodiment is shorter than the appropriate value by 0.1 mm.
Figure 12:
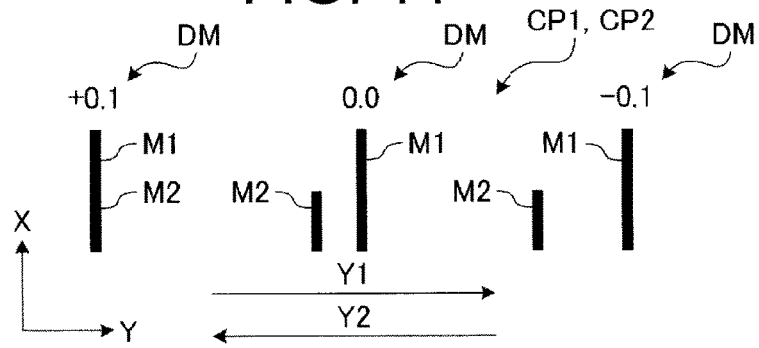
FIG. 12 is a view showing check patterns in the forward path and the backward path of when the gap of the gap adjustment method of the ink jet device according to the embodiment is longer than the appropriate value by 0.1 mm.
Figure 13:
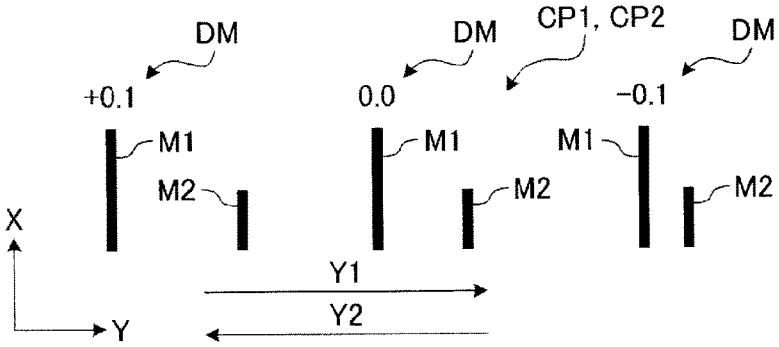
FIG. 13 is a view showing check patterns in the forward path and the backward path of when the gap of the gap adjustment method of the ink jet device according to the embodiment is shorter than the appropriate value by 0.2 mm.
Figure 14:
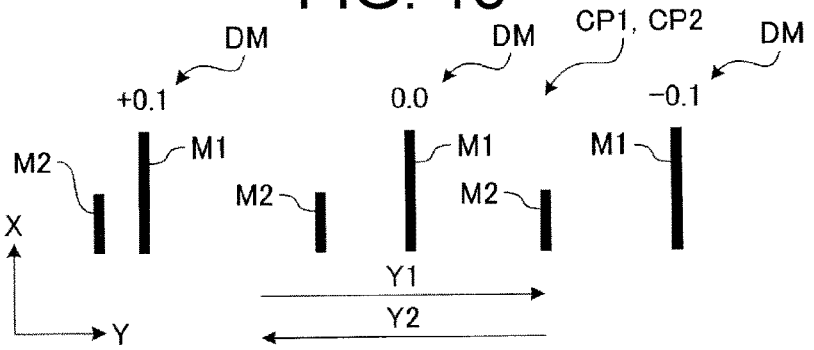
FIG. 14 is a view showing check patterns in the forward path and the backward path of when the gap of the gap adjustment method of the ink jet device according to the embodiment is longer than the appropriate value by 0.2 mm.

Next, the gap adjustment method of the ink jet device according to the present embodiment will be described in detail based on the drawings. FIG. 6 is a view showing one part of a flow showing one example of the gap adjustment method of the ink jet device according to the embodiment. FIG. 7 is a view showing the remaining part of the flow showing one example of the gap adjustment method of the ink jet device according to the embodiment. FIG. 8 is a view showing a check pattern in a forward path of the gap adjustment method of the ink jet device according to the embodiment. FIG. 9 is a view showing a check pattern in a backward path of the gap adjustment method of the ink jet device according to the embodiment. FIG. 10 is a view showing check patterns in the forward path and the backward path of when the gap of the gap adjustment method of the ink jet device according to the embodiment is an appropriate value. FIG. 11 is a view showing check patterns in the forward path and the backward path of when the gap of the gap adjustment method of the ink jet device according to the embodiment is shorter than the appropriate value by 0.1 mm. FIG. 12 is a view showing check patterns in the forward path and the backward path of when the gap of the gap adjustment method of the ink jet device according to the embodiment is longer than the appropriate value by 0.1 mm. FIG. 13 is a view showing check patterns in the forward path and the backward path of when the gap of the gap adjustment method of the ink jet device according to the embodiment is shorter than the appropriate value by 0.2 mm. FIG. 14 is a view showing check patterns in the forward path and the backward path of when the gap of the gap adjustment method of the ink jet device according to the embodiment is longer than the appropriate value by 0.2 mm.

The gap adjustment method of the ink jet device according to the present embodiment (hereinafter simply referred to as gap adjustment method) is a method of adjusting a length of the gap G, that is the distance of the gap G between the ink discharge port 10 of the head unit 11 and the to-be-printed surface of the print medium W held by the print medium holding unit 20 to an appropriate value. An appropriate value of the length of the gap G is a distance at which a predetermined figure corresponding to the input image information can be printed on the to-be-printed surface of the print medium W by an image formed by moving the head unit in a forward path direction indicated with an arrow Y1 in FIG. 8 and the like, which is one direction of the main scanning direction of the head unit 11, and discharging the ink, and an image formed by moving the head unit in a backward path direction indicated with an arrow Y2 in FIG. 9 and the like, which is the other direction, and discharging the ink. In other words, an appropriate value of the length of the gap G refers to a value the ink discharged from the ink discharge port 10 of the head unit 11 moving in the forward path direction Y1 and the ink discharged from the ink discharge port 10 of the head unit 11 moving in the backward path direction Y2 can be landed at the same position, when desiring to land the ink discharged from the ink discharge port 10 of the head unit 11 moving in the forward path direction Y1 and the ink discharged from the ink discharge port 10 of the head unit 11 moving in the backward path direction Y2 at the same position.

As shown in FIG. 3, in the gap adjustment method according to the present embodiment, the ink droplet discharged from the ink discharge port 10 of the head unit 11 is landed on a thin film F attached in a strippable manner to the to-be-printed surface of at least one print medium W of a plurality of print media W held by the print medium holding unit 20 to form the check patterns CP1, CP2 shown in one of FIGS. 10 to 14. The thin film F includes, for example, that made from a synthetic resin and having a thickness of less than 0.1 mm, and on which an adhesive layer to be attached to the to-be-printed surface of the print medium W is formed. For the amount of thickness of the thin film F, a correction for an amount of thickness is preferably added to the optimum landing position determined in advance.

In the gap adjustment method according to the present embodiment, the ink is discharged from the ink discharge port 10 and the ink droplet is landed at the forward path landing position of the print medium W while moving the head unit 11 in the forward path direction Y1 to form the check pattern CP1 shown in FIG. 8. In the gap adjustment method, the ink is discharged from the ink discharge port 10 and the ink droplet is landed at the backward path landing position of the print medium W while moving the head unit 11 in the backward path direction Y2 to form the check pattern CP2 shown in FIG. 9. The check patterns CP1, CP2 include three of each linear mark M1, M2 spaced apart in the main scanning direction and provided parallel to the sub-scanning direction. A length L1 in the sub-scanning direction of the mark M1 of the check pattern CP1 is longer than a length L2 in the sub-scanning direction of the mark M2 of the check pattern CP2, so that the forward path and the backward path can be easily distinguished. Furthermore, an interval D1 between the marks M1 in the main scanning direction of the check pattern CP1 is wider than an interval D2 between the marks M2 in the main scanning direction of the check pattern CP2.

The forward path landing position refers to a position where the ink is discharged from the ink discharge port 10 and the ink droplet is landed on the to-be-printed surface of the print medium W while moving the head unit 11 in the forward path direction Y1. In other words, the forward path landing position refers to a position where the mark M1 is formed on the to-be-printed surface of the print medium W. Furthermore, the backward path landing position refers to a position where the ink is discharged from the ink discharge port 10 and the ink droplet is landed on the to-be-printed surface of the print medium W while moving the head unit 11 in the backward path direction Y2. In other words, the backward path landing position refers to a position where the mark M2 is formed on the to-be-printed surface of the print medium W.

In the present embodiment, if the length of the gap G is an appropriate value, the central marks M1, M2 are overlapped, and the marks M2 at both ends of the check pattern CP2 are formed between the marks M1 at both ends of the check pattern CP1 on the to-be-printed surface of the print medium W, as shown in FIG. 10. The check patterns CP1, CP2 shown in FIG. 10 show a case in which the positions are coincided with the optimum landing position of the ink droplet determined in advance according to the desired gap G. In other words, the check patterns CP1, CP2 shown in FIG. 10 show a case in which there is no shift between actual measurement values of the forward path landing position and the backward path landing position, and an optimum value or an optimum landing position of when the length of the gap G is an appropriate value. Thus, the check patterns CP1, CP2 shown in FIG. 10 indicate the actual measurement values of the forward path landing position and the backward path landing position, and the optimum value or the optimum landing position of when the length of the gap G is an appropriate value. The colors of the marks M1, M2 may be different from each other or may be the same, but the colors that allow the marks M1, M2 to be easily identified are desired.

Furthermore, the check pattern CP1 includes a discrimination mark DM as information that corresponds to each mark M1 and that contributes to discriminating the degree of adjusting the length of the gap G in the gap adjusting process. The discrimination mark DM indicates whether the length of the gap G is an appropriate value or is longer than or shorter than the appropriate value when the mark M2 of the check pattern CP2 is overlapped on the corresponding mark M1 of the check pattern CP1. Specifically, the discrimination mark DM is arranged at a position lined in the sub-scanning direction with the corresponding mark M1 of the check pattern CP1. The discrimination mark DM corresponding to the central mark M1 of the check pattern CP1 is a mark of "0.0 mm" indicating that the length of the gap G is an appropriate value when the central mark M2 of the check pattern CP2 is overlapped on the central mark M1 of the check pattern CP1. Furthermore, the discrimination mark DM corresponding to the mark M1 at the left end of the check pattern CP1, that is, on the back side in the forward path direction Y1 is a mark of "+0.1 mm" indicating that the length of the gap G is longer than the appropriate value by 0.1 mm, when the mark M2 at the left end of the check pattern CP2, that is, on the front side in the backward path direction Y2 is overlapped on the mark M1 at the left end of the check pattern CP1. Moreover, the discrimination mark DM corresponding to the mark M1 at the right end of the check pattern CP1, that is, on the front side in the forward path direction Y1 is a mark of "−0.1 mm" indicating that the length of the gap G is shorter than the appropriate value by 0.1 mm, when the mark M2 at the right end of the check pattern CP2, that is, on the back side in the backward path direction Y2 is overlapped on the mark M1 at the right end of the check pattern CP1.

First, in the gap adjustment method according to the present embodiment, the holding unit 23*a* of the work set member 23 of the print medium holding unit 20 is caused to hold the print medium W, and the user attaches the thin film F to the to-be-printed surface of at least one print medium W. Then, the user inputs a rotation angle of the shaft member 22 of the rotation driving unit 24 from the input device 90 so that the to-be-printed surface attached with the thin film F becomes parallel to both the main scanning direction and the sub-scanning direction (step ST1). The control device 60 then rotates the shaft member 22 of the print medium holding unit 20 about the shaft center, and causes the to-be-printed surface attached with the thin film F of the print medium W held by the holding unit 23*a* of the work set member 23 to be parallel to both the main scanning direction and the sub-scanning direction.

Furthermore, the control device 60 causes the sub-scanning direction driving unit 50 and the gap driving unit 40 to move the print medium holding unit 20 in the sub-scanning direction and the Z-axis direction thus moving the print medium W held by the holding unit 23*a* of the work set member 23 of the print medium holding unit 20 and attached with the thin film F to the lower side of the housing 2, and detects at least the print medium W attached with the thin film F with the laser sensor 70 (step ST2). Thereafter, the user defines the forward path landing position and the backward path landing position of the ink for forming the check patterns CP1, CP2 in the main scanning direction and the sub-scanning direction of the to-be-printed surface of the print medium W attached with the thin film F, and inputs the same from the input device 90 to the control device 60 (step ST3).

The control device 60 then causes the sub-scanning direction driving unit 50, the gap driving unit 40, and the carriage driving unit 30 to position the head unit 11 at an appropriate position with respect to the forward path landing position and the backward path landing position input from the input device 90. In this case, the length of the gap G is a predetermined value between 1.0 mm and 1.5 mm. The control device 60 carries out a discharging process of forming the check patterns CP1, CP2 (step ST4). The discharging process discharges the ink from the ink discharge port 10 while reciprocating the carriage 12 at a constant speed in the main scanning direction to land the ink droplet at each of the forward path landing position of landing the ink droplet on the print medium W in the forward path and the backward path landing position of landing the ink droplet on the print medium W in the backward path. The moving speeds in the forward path direction Y1 and the backward path direction Y2 of the carriage 12 in the discharging process are the same or the moving speeds are constant.

Furthermore, in the discharging process, the control device 60 discharges the ink from the ink discharge port 10 while moving the carriage 12 in the forward path direction Y1 to form the check pattern CP1, and discharges the ink from the ink discharge port 10 while moving the carriage 12 in the backward path direction Y2 to form the check pattern CP2. Thus, when moving the carriage 12 in the forward path direction Y1 and the backward path direction Y2 in the discharging process, the control device 60 lands the ink droplet at three or more areas on the thin film F attached to the to-be-printed surface and also differs a temporal interval in which the carriage 12 discharges the ink while moving in the forward path direction Y1 and a temporal interval in which the carriage 12 discharges the ink while moving in the backward path direction Y2. Furthermore, in the discharging process, the temporal interval in which the carriage 12 discharges the ink while moving in the forward path direction Y1 is constant. Moreover, the temporal interval in which the carriage 12 discharges the ink while moving in the backward path direction Y2 is constant and is shorter than the temporal interval in which the carriage 12 discharges the ink while moving in the forward path direction Y1. Furthermore, in the discharging process, the control device 60 forms the check pattern CP1 and provides the discrimination mark DM on the thin film F on the to-be-printed surface of the print medium W.

As shown in one of FIGS. 10, 11, 12, 13, or 14, the actual measurement values based on the check patterns CP1, CP2, that is, the forward path landing position and the backward path landing position are formed on the thin film F attached to the to-be-printed surface of the print medium W. Thus, the actual measurement values based on the forward path landing position and the backward path landing position refer to the marks M1, M2 of the check patterns CP1, CP2 formed on the to-be-printed surface of the print medium W in the discharging process. Thereafter, the user determines whether any of the mark M1 of the check pattern CP1 or the mark M2 of the check pattern CP2 is overlapped (step ST5). When determining that neither the mark M1 of the check pattern CP1 nor the mark M2 of the check pattern CP2 is overlapped (step ST5: Yes), the user determines whether or not all the marks M2 of the check pattern CP2 are on the front side in the forward path direction Y1 with respect to all the marks M1 of the check pattern CP1 (step ST51).

As shown in FIG. 13, when the user determines that all the marks M2 of the check pattern CP2 are on the front side in the forward path direction Y1 with respect to all the marks M1 of the check pattern CP1 (step ST51: Yes), the user selects "−0.2 mm" of lowering the print medium holding unit 20 by 0.2 mm in the Z axis direction to be away from the head unit 11 from the menu of the input device 90 (step ST52), and the control device 60 lowers the print medium holding unit 20 by 0.2 mm in the Z axis direction (step ST53).

When the user determines that all the marks M2 of the check pattern CP2 are not on the front side in the forward path direction Y1 with respect to all the marks M1 of the check pattern CP1, that is, when the user determines that all the marks M2 of the check pattern CP2 are on the back side in the forward path direction Y1 with respect to all the marks M1 of the check pattern CP1 as shown in FIG. 14 (step ST51: No), the user selects "+0.2 mm" of raising the print medium holding unit 20 by 0.2 mm in the Z axis direction to be closer to the head unit 11 from the menu of the input device 90 (step ST54), and the control device 60 raises the print medium holding unit 20 by 0.2 mm in the Z axis direction (step ST55).

After lowering the print medium holding unit 20 by 0.2 mm in the Z axis direction (step ST53) or raising the print medium holding unit 20 by 0.2 mm (step ST55), the control device 60 shifts the forward path landing position and the backward path landing position of the ink on the thin film F of when forming the check patterns CP1, CP2 with the sub-scanning direction driving unit 50 and the carriage driving unit 30, or the user again specifies the forward path landing position and the backward path landing position from the input device 90 (step ST56), and the process returns to step ST4. Step ST4 to step ST56 are thus repeated until one of the marks M1 of the check pattern CP1 and one of the marks M2 of the check pattern CP2 overlap.

When determining that any of the mark M1 of the check pattern CP1 and the mark M2 of the check pattern CP2 is overlapped (step ST5: No), the user determines whether or not the mark M2 at the right end of the check pattern CP2 is overlapped on the mark M1 at the right end of the check pattern CP1, that is, on the most front side in the forward path direction Y1 (step ST61). As shown in FIG. 11, when determining that the mark M2 at the right end of the check pattern CP2 is overlapped on the mark M1 at the right end of the check pattern CP1 (step ST61: Yes), the user selects "−0.1 mm" of lowering the print medium holding unit 20 by 0.1 mm in the Z axis direction to be away from the head unit 11 from the menu of the input device 90, and the control device 60 lowers the print medium holding unit 20 by 0.1 mm in the Z axis direction (step ST62).

When determining that the mark M2 at the right end of the check pattern CP2 is not overlapped on the mark M1 at the right end of the check pattern CP1 (step ST61: No), the user determines whether or not the central mark M2 of the check pattern CP2 is overlapped on the central mark M1 of the check pattern CP1 (step ST63). As shown in FIG. 10, when determining that the central mark M2 of the check pattern CP2 is overlapped on the central mark M1 of the check pattern CP1 (step ST63: Yes), the user selects "0.0 mm" of maintaining the position in the Z axis direction of the print medium holding unit 20 from the menu of the input device 90, and the control device 60 maintains the position in the Z axis direction of the print medium holding unit 20 (step ST64).

When determining that the central mark M2 of the check pattern CP2 is not overlapped on the central mark M1 of the check pattern CP1 (step ST63: No), the user determines whether or not the mark M2 at the left end of the check pattern CP2 is overlapped on the mark M1 at the left end of the check pattern CP1, that is, on the most back side in the forward path direction Y1 (step ST65). As shown in FIG. 12, when determining that the mark M2 at the left end of the check pattern CP2 is overlapped on the mark M1 at the left end of the check pattern CP1 (step ST65: Yes), the user selects "+0.1 mm" of raising the print medium holding unit 20 by 0.1 mm in the Z axis direction to be closer to the head unit 11 from the menu of the input device 90, and the control device 60 raises the print medium holding unit 20 by 0.1 mm in the Z axis direction (step ST66).

Thus, step ST5 to step ST66 compare the actual measurement value of the discharging process shown in FIGS. 10 to 14 and the optimum value shown in FIG. 10, and adjusts the length of the gap G with the gap driving unit 40 so that the actual measurement value matches the optimum value or approaches the optimum value based on the shift in the main scanning direction of such values. Furthermore, in the gap adjusting process, step ST51 to step ST4 are repeated, and when carrying out step ST5 to step ST66 to compare the actual measurement value and the optimum value, the degree of adjusting the length of the gap G, that is, the lowering amount and the raising amount of the print medium holding unit 20 are determined based on a separated distance of the actual measurement values, that is, the distance in the main scanning direction between the marks M1 and M2 and/or the separated direction in the main scanning direction of the marks, that is, the position relationship of each other such as whether the mark M2 is on the front side or the back side in the forward path direction Y1 with respect to the mark M1.

In the present embodiment, the optimum value based on the optimum landing position is such the marks M1, M2 are overlapped, but the marks may not necessarily be overlapped and may be arbitrarily arranged if the relative position relationship of the marks M1, M2 is defined in advance as the optimum value based on the optimum landing position. The separated degree and the separated direction are also not limited to the main scanning direction, and may be set to an arbitrary direction including the sub-scanning direction.

Furthermore, the actual measurement value based on the forward path landing position and the backward path landing position and the optimum value do not indicate only the separated distance in the main scanning direction, and, for example, can be applied to the overall numerical values shown on the coordinate axes of the X-Y direction such as "−0.1 mm in the X direction, 0.3 mm in the Y direction".

After the user determines that the mark M2 at the right end of the check pattern CP2 is not overlapped on the mark M1 at the right end of the check pattern CP1 (step ST61: No), and after the control device 60 lowers the print medium holding unit 20 (step ST62), maintains the position of the print medium holding unit 20 (step ST64), and raises the print medium holding unit 20 (step ST66), that is, after the gap adjusting process, a height in the Z axis direction of the print medium holding unit 20 at which the length of the gap G becomes an appropriate value is displayed on the display device 80 of the ink jet printer 1 (step ST7). Thereafter, the control device 60 sets the print medium holding unit 20 to the height in the Z axis direction at which the length of the gap G becomes an appropriate value (step ST8).

The ink jet printer 1 has the length of the gap G adjusted in such manner. The ink jet printer 1 discharges the ink from the ink discharge port 10 while reciprocating the carriage 12 in the main scanning direction to land the ink droplet on the print medium W at each of the forward path landing position of landing the ink droplet on the print medium W in the forward path and the backward path landing position of landing the ink droplet on the print medium W in the backward path. The length of the gap G is thereby adjusted by the gap driving unit 40 based on the check patterns CP1, CP2 formed on the print medium W.

According to the gap adjustment method of the present embodiment, in the discharging process, the ink is discharged respectively for when moving the carriage 12 in the forward path direction Y1 and in the backward path direction Y2, and the length of the gap G is adjusted by the gap driving unit 40 on the basis of the optimum value based on the optimum landing position determined in advance in the gap adjusting process, and the marks M1, M2, which are actual measurement values, based on the landing position of the ink droplet formed in the discharging process. Thus, the length of the gap G can be adjusted without using an expensive sensor such as a photosensor. Furthermore, since the length of the gap G is adjusted by the gap driving unit 40 on the basis of the optimum value based on the optimum landing position determined in advance, and the actual measurement value based on the landing position formed by the discharging process, the calibration curve does not need to be recreated according to the change in environment, and the like and the convenience can be enhanced. Thus, the gap adjustment method can enhance the convenience even when the ink jet printer 1 has a simple configuration. In other words, the gap adjustment method of the present embodiment can carry out the gap adjustment of the ink jet device with a simple configuration, and can enhance the convenience of the gap adjustment.

In the gap adjustment method of the present embodiment, the height in the Z axis direction of the print medium holding unit 20 is adjusted when adjusting the length of the gap G. Thus, frequent change in the shape and the thickness of the print medium W can be responded without changing the position on the ink discharge port 10 side, thus further enhancing the convenience as the ink jet printer 1.

In the gap adjustment method of the present embodiment, the ink droplet is landed at three or more areas to form the marks M1, M2 at three or more areas of the thin film F upon moving the carriage 12 in the forward path direction Y1 and the backward path direction Y2. Thus, according to the gap adjustment method of the present embodiment, the shift between the actual measurement values of the forward path landing position and the backward path landing position of the forward path direction Y1 and the backward path direction Y2 can be definitely determined. Furthermore, since the shift can be grasped based on the actual measurement values of the forward path landing position and the backward path landing position at three or more areas, the direction of shift, the position of small shift, and the like can be grasped.

Furthermore, in the gap adjustment method of the present embodiment, the moving speed of the carriage 12 in discharging the ink from the ink discharge port 10 is constant, and hence the length of the gap G that becomes an optimum value based on the optimum landing position can be easily grasped. Moreover, the shift range of the mark M1 indicating the actual measurement value based on the forward path landing position in the forward path direction Y1 and the mark M2 indicating the actual measurement value based on the backward path landing position in the backward path direction Y2 becomes constant, and discrimination can be easily carried out.

In the gap adjustment method of the present embodiment, the degree of adjusting the length of the gap G is discriminated based on the mark M1 of the check pattern CP1 formed in the forward path direction Y1 and the mark M2 of the check pattern CP2 formed in the backward path direction Y2. Therefore, according to the gap adjustment method of the present embodiment, the degree of adjusting the length of the gap G can be determined by landing the ink while moving the carriage 12 in the forward path direction Y1 and the backward path direction Y2 one time each. Thus, the size of the gap G can be adjusted easily and rapidly. In the gap adjustment method of the present embodiment, the movement of the carriage 12 in the forward path direction Y1 and the backward path direction Y2 is not limited to one time each, and may be carried out plural times in one direction or plural times each in both directions. In particular, when attempting to make the driving waveform for discharging the ink from the ink discharge port 10 constant, the check pattern CP1 may be created in the forward path or the backward path, and then the scanning and the discharging may be repeated over plural times in the backward path or the forward path to form the mark M2 thus creating the check pattern CP2.

Furthermore, in the gap adjustment method of the present embodiment, the discrimination mark DM is also provided when forming the check patterns CP1, CP2, whereby the degree of adjusting the length of the gap G can be easily and rapidly determined, and the convenience can be enhanced.

In the gap adjustment method of the present embodiment, the discharging process is carried out on the thin film F attached to the print medium W in a strippable manner, and hence the check patterns CP1, CP2 can be formed on the print medium W to which the ink jet printer 1 actually carries out the printing. Thus, in the gap adjustment method, the length of the gap G can be adjusted by actually landing the ink with respect to the print medium W, whereby the length of the gap G can be reliably adjusted without being influenced by the variation in the dimension of the print medium W. Furthermore, the length of the gap G can be adjusted without getting the print medium W dirty since the strippable thin film F is used.

In the gap adjustment method of the present embodiment, the interval of discharging the ink in each of the forward path and the backward path is constant, and thus the degree of adjusting the length of the gap G can be easily and rapidly determined based on the landing position of the ink.

According to the ink jet printer 1 of the present embodiment, the length of the gap G is adjusted by the gap adjustment method described above, and thus the length of the gap G can be adjusted with a simple configuration, and the convenience of when adjusting the length of the gap G can be enhanced.

The ink jet printer 1 can define the forward path landing position and the backward path landing position of the ink on the print medium W when forming the check patterns CP1, CP2, and can position the ink discharge port 10 at an appropriate position with respect to the forward path landing position and the backward path landing position. Thus, the ink jet printer 1 can reliably form the check patterns CP1, CP2 at a predetermined position of the print medium W. Furthermore, since the position determining means provided in the input device 90 determines the forward path landing position and the backward path landing position based on the appropriate gap G, the printing can be reliably carried out even if the print medium W is a limited range shown in FIG. 3, and application can also be made to the print medium which barely tolerates margin.

Figure 15:
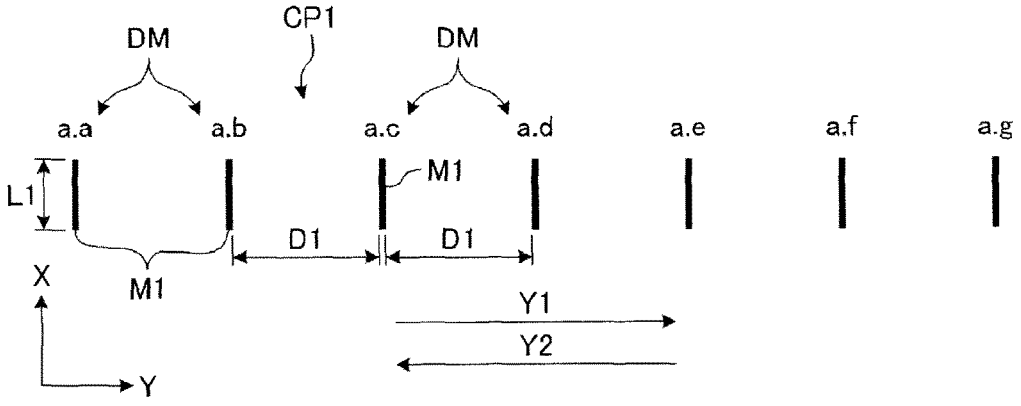
FIG. 15 is a view showing a check pattern in a forward path of a gap adjustment method of an ink jet device according to a variant of the embodiment.
Figure 16:
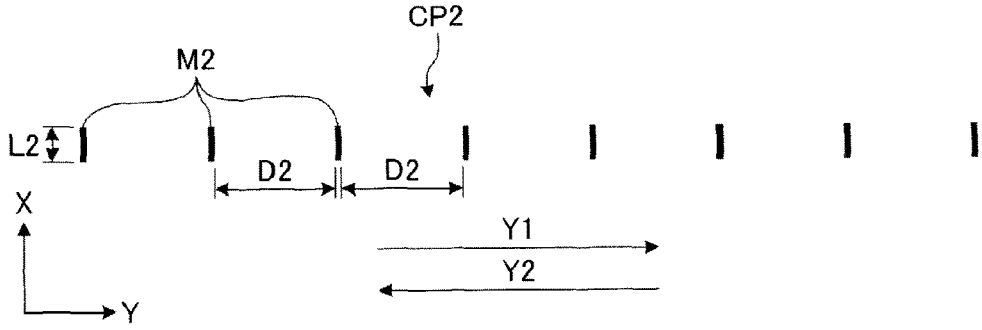
FIG. 16 is a view showing a check pattern in a backward path of the gap adjustment method of the ink jet device according to the variant of the embodiment.
Figure 17:
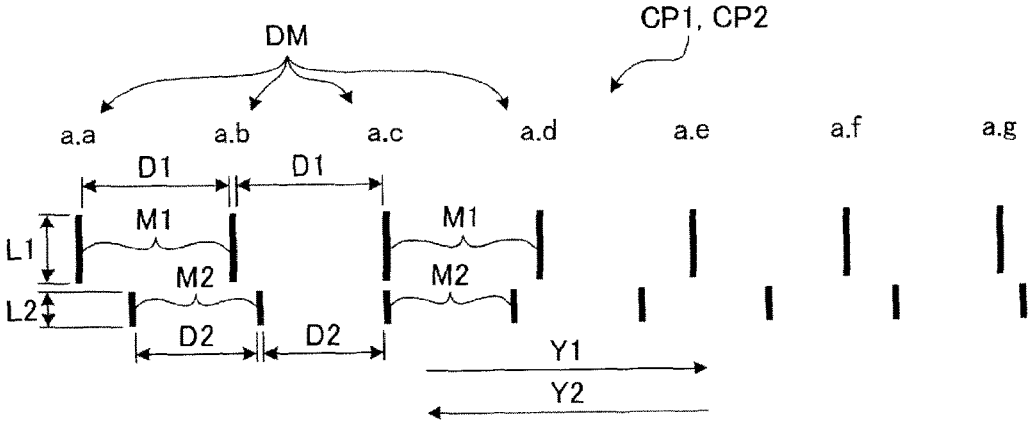
FIG. 17 is a view showing one example of a check pattern formed on a to-be-printed surface of a print medium of the gap adjustment method of the ink jet device according to the variant of the embodiment.

[Variant] Next, a gap adjustment method of an ink jet device according to a variant of the embodiment will be described based on the drawings. FIG. 15 is a view showing a check pattern in a forward path of a gap adjustment method of an ink jet device according to the variant of the embodiment. FIG. 16 is a view showing a check pattern in a backward path of the gap adjustment method of the ink jet device according to the variant of the embodiment. FIG. 17 is a view showing one example of a check pattern formed on a to-be-printed surface of a print medium of the gap adjustment method of the ink jet device according to the variant of the embodiment. The same reference numerals are denoted on the same portions as the embodiment in FIGS. 15 to 17, and the description thereof will be omitted.

In the gap adjustment method of the ink jet device according to the variant of the embodiment (hereinafter referred to as gap adjustment method), the check patterns CP1, CP2 include a great number of linear marks M1, M2 spaced apart in the main scanning direction and provided parallel to the sub-scanning direction, as shown in FIGS. 15 and 16. The discrimination mark DM corresponding to each mark M1 of the check pattern CP1 indicates an appropriate value of the length of the gap G. In other words, the discrimination mark DM corresponding to each mark M1 of the check pattern CP1 indicates an appropriate value of the length of the gap G when the mark M2 is overlapped on the mark M1 or when lined in the sub-scanning direction. For example, when the mark M2 is overlapped on the mark M1 or when lined in the sub-scanning direction, which is "a.b", the discrimination mark DM indicates that the appropriate value of the length of the gap G is a.b mm.

As shown in FIG. 17, the gap adjustment method according to the variant of the embodiment forms the check patterns CP1, CP2 on the thin film F attached to the to-be-printed surface of the print medium W, and thereafter, the user extracts the marks M1, M2 in which the shift in the main scanning direction is the least, that is, the marks M1, M2 lined in the sub-scanning direction of the marks M1, M2 of the check patterns CP1, CP2. The user then reads the discrimination mark DM corresponding to the extracted mark M1 and inputs the read value from the input device 90, and the control device 60 sets the length of the gap G to the value input from the input device 90. In the example shown in FIG. 17, the discrimination mark DM corresponding to the mark M1 of the marks M1, M2 lined in the sub-scanning direction is "a.c". Thus, in the example shown in FIG. 17, the user inputs "a.c" from the input device 90, and the control device 60 adjusts the length of the gap G to a.c mm.

Similar to the embodiment, the gap adjustment method according to the variant of the embodiment discharges the ink respectively for when moving the carriage 12 in the forward path direction Y1 and the backward path direction Y2, and adjusts the length of the gap G on the basis of the actual measurement values based on the forward path landing position and the backward path landing position of the ink droplet in the gap adjusting process. Therefore, the gap adjustment method can allow the ink jet printer 1 to have a simple configuration and can enhance the convenience, similar to the embodiment. Furthermore, the gap adjustment method according to the variant extracts the marks M1, M2 lined in the sub-scanning direction from the check patterns CP1, CP2 formed on the to-be-printed surface of the print medium W, and the user inputs a value indicated by the discrimination mark DM corresponding to the extracted mark M1 from the input device 90 to adjust the length of the gap G to an appropriate value. Therefore, the gap adjustment method according to the variant can rapidly adjust the length of the gap G to an appropriate value.

In the embodiment and the variant described above, the check patterns CP1, CP2 are formed on the print medium W to which the ink jet printer 1 actually carries out the printing. However, in the present invention, the check patterns CP1, CP2 may be formed on a landing target object having the same shape as the print medium W, other than the print medium W to which the ink jet printer 1 actually carries out the printing. Furthermore, in the embodiment and the variant described above, the check patterns CP1, CP2 are formed on one to-be-printed surface of the print medium W, but of course, it is desirable that the check patterns CP1, CP2 be formed on each to-be-printed surface of the print medium W and the length of the gap G be adjusted for every to-be-printed surface in the present invention. Moreover, in the embodiment and the variant, the check patterns CP1, CP2 include three or more marks M1, M2, but in the present invention, at least one mark M1, M2 or landing position merely needs to be formed in each of the forward path and the backward path, in which case, the gap to be adjusted may be set by comparing the position of the mark M2 with respect to the mark M1.

A film may be attached to the work, and the printing may be carried out on the film. In this case, using the gap adjustment method according to the present invention, the thickness of the film can be estimated at high accuracy using the shift range of the optimum landing position and when the film is attached.

The invention claimed is:

1. A gap adjustment method of an ink jet device, wherein the ink jet device includes a head unit with an ink discharge port that discharges ink, a carriage that is provided with the head unit and moves in a main scanning direction, a landing target object provided with a gap with respect to the ink discharge port, and a gap adjustment means that adjusts a length of the gap; wherein the gap adjustment method comprises:

a discharging process of discharging ink from the ink discharge port while reciprocating the carriage in the main scanning direction, and landing an ink droplet to each of a forward path landing position, which is a position on the landing target object the ink droplet is to be landed in a forward path of the carriage, and a backward path landing position, which is a position on the landing target object the ink droplet is to be landed in a backward path of the carriage; and a gap adjusting process of comparing actual measurement values based on the forward path landing position and the backward path landing position the ink droplet actually lands in the discharging process, and optimum values based on respective optimum landing positions of the forward path landing position and the backward path landing position determined in advance according to a desired gap, and adjusting the length of the gap with the gap adjustment means based on a shift of the actual measurement values and the optimum values, wherein in the discharging process, the ink droplet is landed at three or more areas in each of the forward path and the backward path, and an interval of discharging the ink in the forward path and an interval of discharging the ink in the backward path are differed.

2. The gap adjustment method of the ink jet device as set forth in claim 1, wherein the adjustment of the length of the gap is carried out based on a separated distance of the actual measurement values of the forward path landing position and the backward path landing position and/or a position relationship of each other in the main scanning direction.

3. The gap adjustment method of the ink jet device as set forth in claim 1, wherein in the discharging process, a moving speed of the carriage when discharging the ink from the ink discharge port is constant.

4. The gap adjustment method of the ink jet device as set forth in claim 3, wherein in the discharging process, information contributing to determining a degree of adjusting the length of the gap in the gap adjusting process is provided on the landing target object.

5. The gap adjustment method of the ink jet device as set forth in claim 1, wherein in the discharging process, the ink is landed on a thin film attached to the landing target object in a strippable manner.

6. The gap adjustment method of the ink jet device as set forth in claim 1, wherein in the discharging process, an interval of discharging the ink to land the ink droplet at three or more areas in the forward path is constant, and an interval of discharging the ink to land the ink droplet at three or more areas in the backward path is constant.

7. An ink jet device comprising:

a head unit with an ink discharge port that discharges ink, a carriage that is provided with the head unit and that moves in a main scanning direction, a landing target object provided with a gap with respect to the ink discharge port, and a gap adjustment means that adjusts a length of the gap; wherein ink is discharged from the ink discharge port while reciprocating the carriage in the main scanning direction, and an ink droplet is landed to each of a forward path landing position, which is a position on the landing target object the ink droplet is to be landed in a forward path of the carriage, and a backward path landing position, which is a position on the landing target object the ink droplet is to be landed in a backward path of the carriage to form a check pattern on the landing target object; and a length of the gap is adjusted with the gap adjustment means based on the check pattern, wherein the forward path landing position and the backward path landing position are controlled by a control device, and the control device is configured for forming the check pattern in which the ink droplet is landed at three or more areas in each of the forward path and the backward path, and an interval of the ink to be landed in the forward path and an interval of the ink to be landed in the backward path are differed.

8. The ink jet device as set forth in claim 7, further comprising:

a position determining means that define the forward path landing position and the backward path landing position of the landing target object in the main scanning direction and a sub-scanning direction orthogonal to the main scanning direction when forming the check pattern; and a head position adjustment means that positions the ink discharge port at an appropriate position with respect to the forward path landing position and the backward path landing position.

* * * * *